US006112542A

United States Patent [19]

Lee

[11] Patent Number: 6,112,542

[45] Date of Patent: Sep. 5, 2000

[54] REFRIGERATOR HAVING A COOLED-AIR PASSAGEWAY FORMED WITH AN EXTERNAL SURFACE OF A LINER

[75] Inventor: Jung Owan Lee, Seoul, Rep. of Korea

[73] Assignee: Daewoo Electronics Co., Ltd., Rep. of Korea

[21] Appl. No.: 09/210,607

[22] Filed: Dec. 15, 1998

[51] Int. Cl.[7] ..... F25D 17/04

[52] U.S. Cl. ..... 62/407; 62/451

[58] Field of Search ..... 62/407, 451

[56] References Cited

U.S. PATENT DOCUMENTS 5,694,788 12/1997 Shin ..... 62/407
5,784,895 7/1998 Choi ..... 62/407
5,819,552 10/1998 Lee ..... 62/407
5,921,104 7/1999 Chang ..... 62/407
5,950,449 9/1999 Park et al. ..... 62/408
5,960,641 10/1999 Kim et al. ..... 62/407

*Primary Examiner*—Henry Bennett
*Assistant Examiner*—Mark Shulman
*Attorney, Agent, or Firm*—Pennie & Edmonds LLP

[57] ABSTRACT

A refrigerator has a storage compartment defined with two lateral walls and a rear wall. The walls has a liner at its innermost surface and a urethane foam outside the liner. The refrigerator is provided with a passageway defined with a sunken portion of the liner which is depressed toward a urethane foam and a cover plate installed within a storage compartment to cover the sunken portion and having an outlet port through which a cooled-air from an evaporator is introduced into the storage compartment.

8 Claims, 5 Drawing Sheets

REFRIGERATOR HAVING A COOLED-AIR PASSAGEWAY FORMED WITH AN EXTERNAL SURFACE OF A LINER

FIELD OF THE INVENTION

The present invention relates to a refrigerator; and, more particularly, to a refrigerator having a cooled-air passageway defined by a sunken portion of a liner and a cover plate covering the sunken portion, resulting in the cooled-air passageway being formed opposite to a thermal insulation layer about the liner.

DESCRIPTION OF THE PRIOR ART

In general, a conventional household refrigerator has a storage compartments, e.g., a freezer compartment or a fresh food compartment in which foods is stored in a cooled-air environment, an evaporator for generating the cooled-air, and passageways through which the cooled-air is supplied from the evaporator to the storage compartments.

There is shown in FIG. 1 one example of the conventional household refrigerators. The refrigerator 1 has an outer liner 7 positioned outmost from a storage compartment, a thermal insulation layer 2 inside the outer liner 7, an inner liner 5 inside the thermal insulation layer 2, a lateral outlet port 4 vertically arranged on a lateral surface 8 of the storage compartment, through which the cooled-air is introduced into the storage compartment and a corner outlet port 6 vertically arranged on a corner defined by a rear surface 9 and the lateral surface 8, at an angle of 45° with the rear surface 9. The thermal insulation layer 2 is made of urethane foam. Positioned on a rear of the inner liner 5 near the corner outlet port 6 and the lateral outlet port 4 is a tubular wall 3*a* defining a passageway for the cooled-air, with the inner liner 5, which communicates between a space of an evaporator (not shown) and the storage compartment.

The conventional refrigerator constructed in this manner, however, has a shortcoming in that it is difficult form the passageway therewithin. That is, since the tubular wall is installed at the rear of the inner liner before the introduction of the urethane to form the thermal insulation layer, the tubular wall may deform or get damaged, resulting in the urethane foams trespassing the passageway, which may, in turn, entail a reinstallation of the passageway or even an additional foaming process of the urethane.

SUMMARY OF THE INVENTION

It is, therefore, a primary object of the invention to provide a refrigerator having a cooled-air passageway defined with a sunken portion of a liner and a cover plate covering the sunken portion, thereby allowing the cooled-air passageway to exist on an opposite side to a thermal insulation layer about the liner.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1:
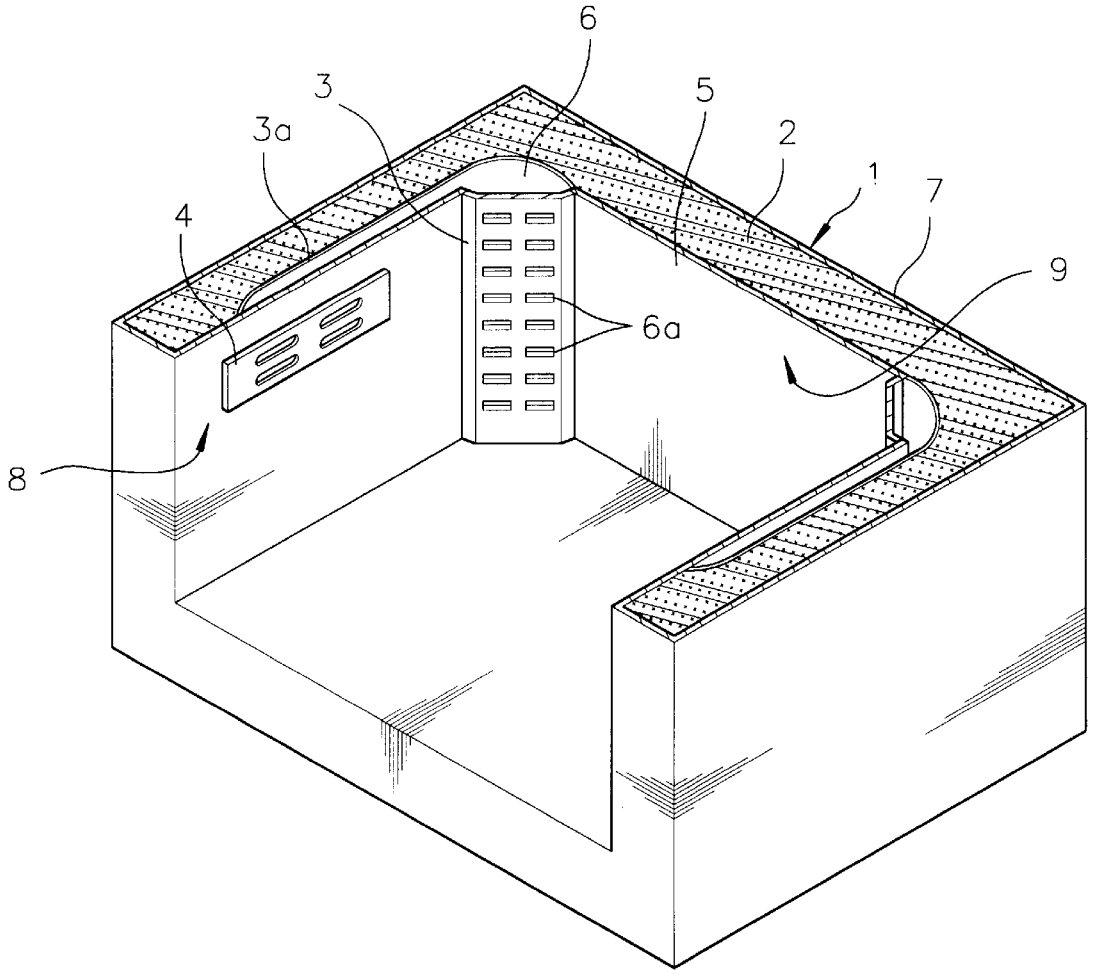
FIG. 1 (PRIOR ART)
FIG. 1 illustrates a sectional perspective view of a prior art refrigerator.
Figure 2:
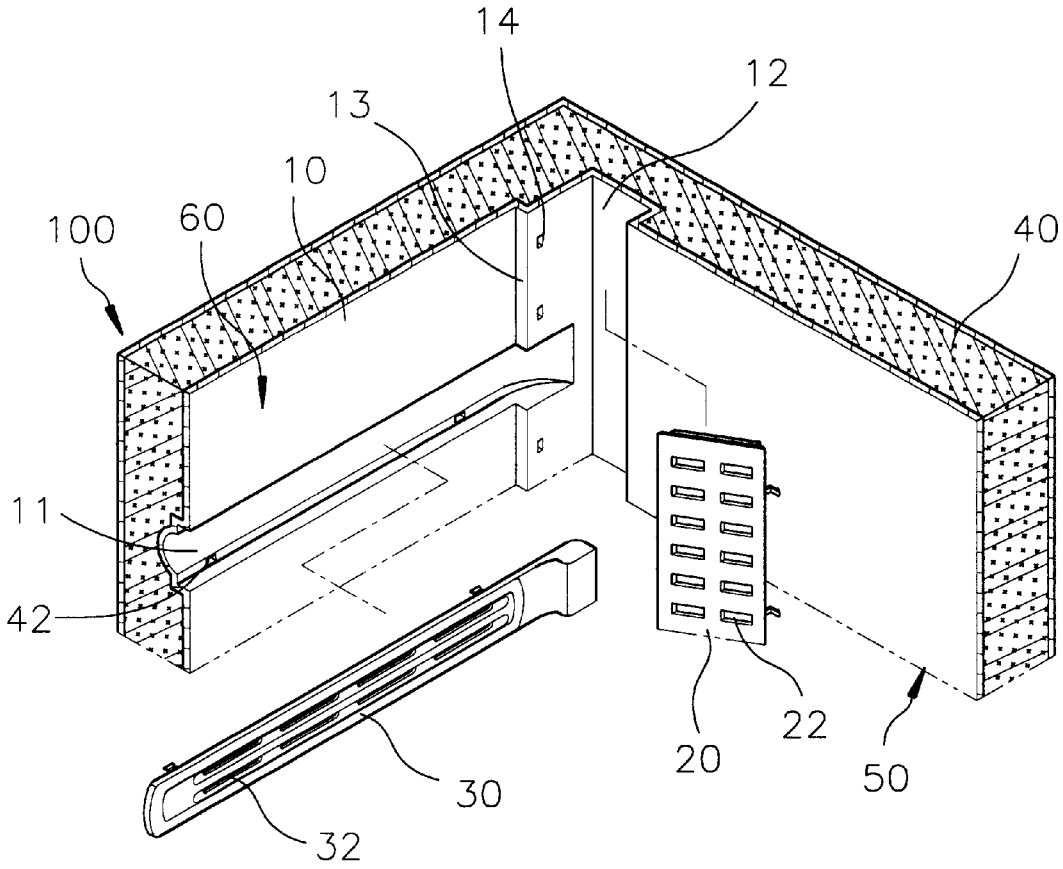
FIG. 2 shows an exploded perspective view of a refrigerator in accordance with the present invention.

Referring to FIG. 2, the inventive refrigerator is provided with a storage compartment defined with a door(not shown), two lateral surfaces 60 (only one is shown) and a rear surface 50, all being provided by a liner 10, the liner 10 being an innermost thin member of the refrigerator 100. Formed outside the liner 10 is a thermal insulation layer 20 made of urethane foams. The storage compartment, for example, may be a fresh food compartment or a freezer compartment. A cooled-air generated by an evaporator is supplied into the storage compartment through an external cooled-air passageway(not shown) which communicates with a corner passageway formed by a corner sunken portion 12 and a vertical cover plate 20.

The corner sunken portion 12 is a concavely sunken from the rear surface 50; and the vertical cover plate 20 is combined with the corner sunken portion 12, forming a main cooled-air passageway for the storage compartment. The vertical cover plate 20 is provided with a plurality of outlet ports 22 through which the cooled-air is introduced into the storage compartment.

A lateral sunken portion 11 is formed with the lateral surface 60. The lateral sunken portion 11 is a concavely sunken from the lateral surface 60 which meets the corner sunken portion 12. A horizontal cover plate 30 is combined with the lateral sunken portion 11 to form a lateral cooled-air passageway for the storage compartment. The lateral and the corner cooled-air passageways communicates with each other. The horizontal cover plate 30 is provided with a plurality of outlet ports 32 through which the cooled-air within the lateral cooled-air passageway is introduced into the storage compartment.

Figure 3:
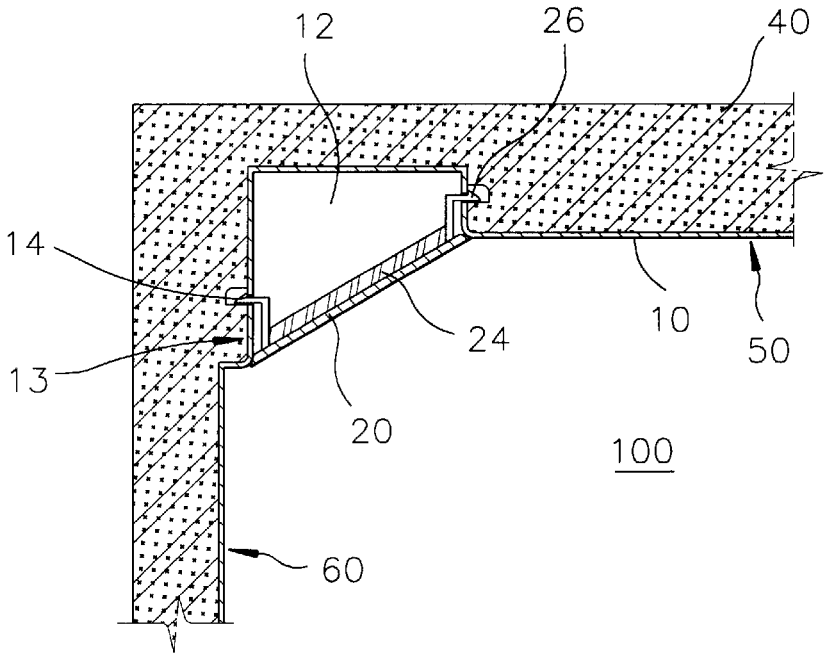
FIG. 3 represents a planar sectional view of the inventive refrigerator.

Referring to FIG. 3, the corner sunken portion 12 and the vertical cover plate 20 which form the corner cooled-air passageway are combined with each other via a plurality of hooks 26 formed with the vertical cover plate 20 and hook receiving holes 14 formed through the corner sunken portion 12. The hooks 26 are formed on both ends of the vertical cover plate 20, respectively. The corner cooled-air passageway is arranged at an angle of 45° with the rear surface to direct the cooled-air toward a center of the storage compartment.

Figure 4:
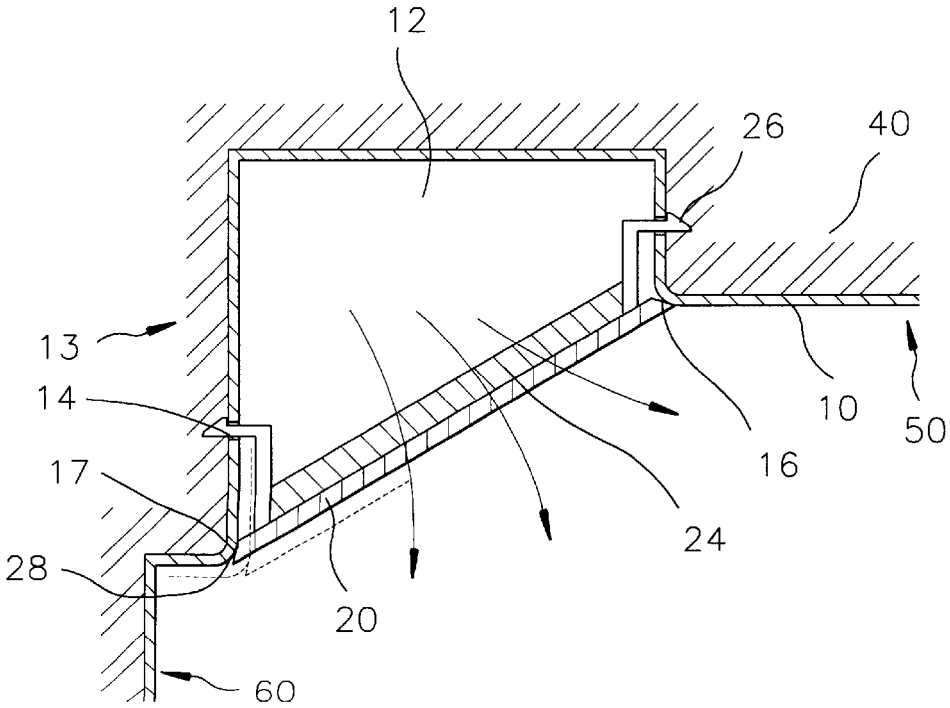
FIG. 4 presents an enlarged planar sectional view of a vertical cooled-air passageway in the inventive refrigerator.

As shown in FIG. 4, according to one aspect of the present invention, a pair of slanted surfaces 28 are formed with both ends of the vertical cover plate 20, respectively. Further, corners 16 and 17 of the corner sunken portion 12 coming into contact with the slanted surfaces 28, respectively, are rounded, allowing the rounded corner 16 and the slanted surface 28 corresponding thereto to meet at one point along an entire length of the vertical cover plate 20, when the vertical cover plate 20 is combined with the corner sunken portion 12.

By this configuration, the contact between the vertical cover plate 20 and the corner sunken portion 12 can be well maintained, even if there may occur variations of shape of the liner 10 after the introduction of the urethane foams to form the thermal insulation layer 2. For example, if the position of the liner 10 of the corner sunken portion 12 becomes moved to the right as indicated with a broken line after the introduction of the urethane, the vertical cover plate 20 can be mounted on the corner sunken portion 12, being translated downwardly, as shown in FIG. 4. Even in this case, a close contact between the vertical cover plate 20 and the corner sunken portion 12 can be obtained, with the contact point moving to other place on the slanted surface 28 from a contact point in which the slanted surface 28 and the rounded corner 17 are to be met if there's no position change of the liner 10. In order to avoid an interference between the vertical cover plate 20 and the lateral surface 60, a corner lateral surface 13 of the corner sunken portion 12 is differently leveled from the lateral surface 60 by a predetermined distance.

In addition, a thermal insulation material 24 is applied on an inner surface of the vertical cover plate 20 to prevent dew from forming on the vertical cover plate 20 due to a temperature difference between an inside and an outside of the vertical cover plate 20.

Figure 5:
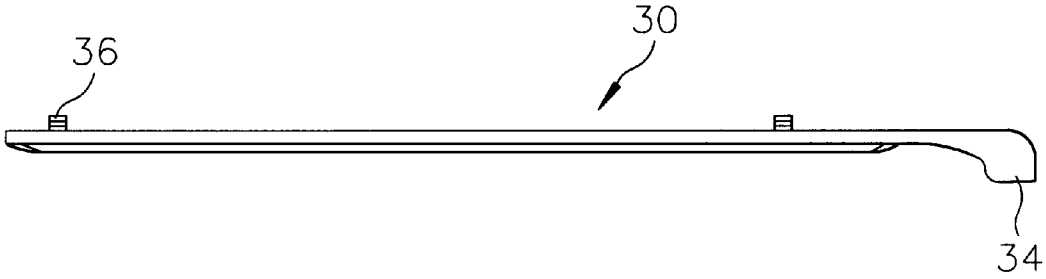
FIG. 5 sets forth a top planar view of a horizontal cover plate employed in the inventive refrigerator.
Figure 6:
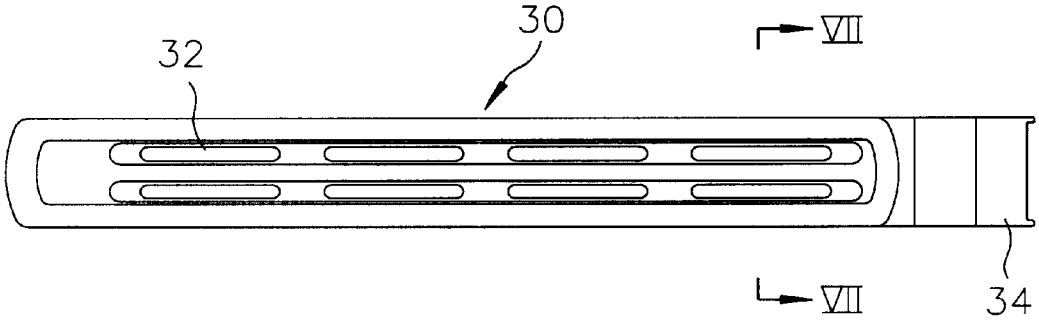
FIG. 6 depicts a frontal elevational view of the horizontal cover plate employed in the inventive refrigerator.
Figure 7:
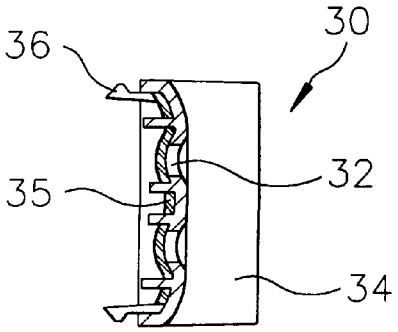
FIG. 7 discloses a side sectional view of the horizontal cover plate in FIG. 6, taken along a line VII—VII.

In FIGS. 5 through 7, there is shown the horizontal cover plate 30 providing the lateral cooled-air passageway. As shown in FIG. 5, the horizontal cover plate 30 is an elongated member with a predetermined width. The horizontal cover plate 30 has a connection portion 34 which covers the level difference between the lateral surface 60 and the corner lateral surface 13. As shown in FIG. 6, the horizontal cover plate 30 further has a plurality of outlet ports 32 formed therethrough. As shown in FIGS. 5 and 7, the horizontal cover plate 30 has a plurality of hooks 36 and a thermal insulation material 35 on an inner surface thereof.

Figure 8:
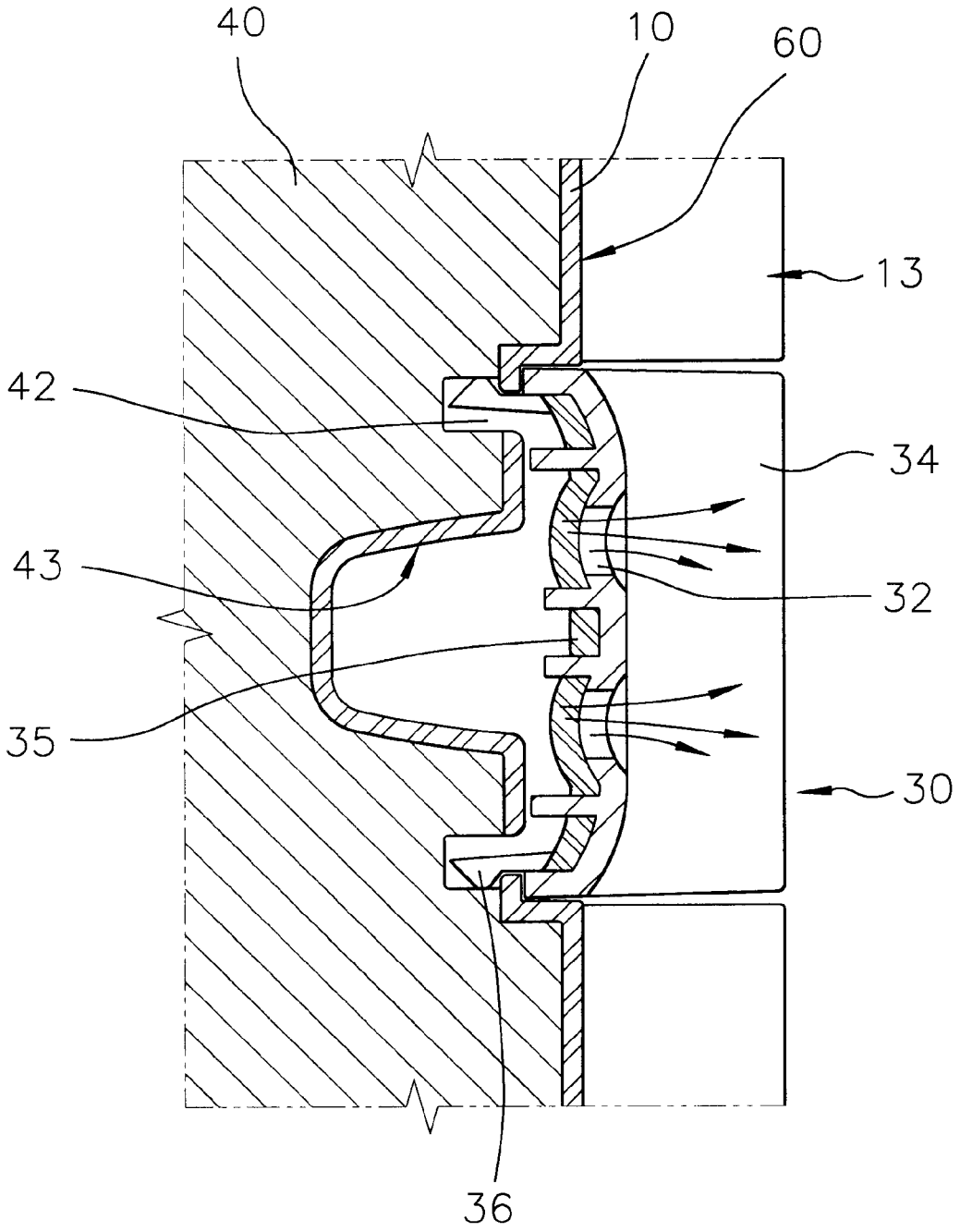
FIG. 8 gives a sectional view of the horizontal cover plate and a lateral sunken portion assembled into the horizontal cover plate.

The horizontal cover plate 30 constructed in this manner, is combined with the lateral sunken portion 11 through which a plurality of hook receiving holes 42 are formed as shown in FIG. 8. The lateral sunken portion 11 has a cross-section of a step-shaped configuration which has a tapered section 43 for preventing the liner 10 of the step-shaped cross-section from being deflected.

Although the invention has been shown and described with respect to the preferred embodiments, it will be understood by those skilled in the art that various changes and modifications may be made without departing from the spirit and scope of the invention as defined in the following claims.

What is claimed is:

1. A refrigerator provided with an evaporator for generating a cooled-air, a storage compartment defined with two lateral walls and a rear wall, the walls having a liner at innermost surfaces thereof and a thermal insulation layer outside the liner, the refrigerator comprising:

a corner sunken portion of the liner on the rear wall depressed toward the thermal insulation layer to form a vertical passageway near a corner at which the rear wall and one of the lateral walls meet each other, the corner sunken portion having rounded portions;

a corner cover plate installed within the storage compartment to cover the corner sunken portion, forming a vertical passageway by cooperating with the corner sunken portion and having a vertical outlet port through which the cooled-air is introduced into the storage compartment, the corner cover plate having slanted surfaces at both ends thereof respectively, which come into a contact with said slanted surfaces, respectively;

a lateral sunken portion of the liner on the lateral sunken portion depressed toward the thermal insulation layer to form a horizontal passageway communicating with said corner sunken portion;

a horizontal cover plate installed within the storage compartment to cover the lateral sunken portion, forming a horizontal passageway by cooperating with the lateral sunken portion and having a horizontal outlet port through which the cooled-air is introduced into the storage compartment; and a fixing means for fixing the corner cover plate to the corner sunken portion and for fixing the lateral cover plate to the lateral sunken portion.

2. The refrigerator of claim 1, wherein the corner and the horizontal cover plates have thermal insulation materials applied on inner surfaces thereof, respectively.

3. The refrigerator of claim 1, wherein said fixing means comprises:

a vertical hook formed at an inner surface of the corner cover plat;

a vertical hook receiving hole formed with the corner sunken portion;

a horizontal hook formed at an inner surface of the horizontal cover plate; and a horizontal hook receiving hole formed with the lateral sunken portion.

4. The refrigerator of claim 1, wherein the lateral sunken portion has a cross-section of a step-shaped configuration.

5. The refrigerator of claim 4, wherein the step-shaped cross-section has a tapered section.

6. The refrigerator of claim 1, wherein said the storage compartment is a freezer compartment.

7. The refrigerator of claim 1, wherein said the storage compartment is a fresh food compartment.

8. A refrigerator provided with an evaporator for generating a cooled-air, a storage compartment defined with two lateral walls and a rear wall, the walls having a liner at innermost surfaces thereof and a thermal insulation layer outside the liner, the refrigerator comprising:

a corner sunken portion of the liner on the rear wall depressed toward the thermal insulation layer to form a vertical passageway near a corner at which the rear wall and one of the lateral walls meet each other;

a corner cover plate installed within the storage compartment to cover the corner sunken portion, forming a vertical passageway by cooperating with the corner sunken portion and having a vertical outlet port through which the cooled-air is introduced into the storage compartment;

a lateral sunken portion of the liner on the lateral sunken portion depressed toward the thermal insulation layer to form a horizontal passageway communicating with said corner sunken portion;

a horizontal cover plate installed within the storage compartment to cover the lateral sunken portion, forming a horizontal passageway by cooperating which the lateral sunken portion and having a horizontal outlet port through with the cooled-air is introduced in to the storage compartment; and a fixing means for fixing the corner cover plate to the corner sunken portion and for fixing the lateral cover plate to the lateral sunken portion, said fixing means comprises a vertical hook formed at an inner surface of the corner cover plate, a vertical hook receiving hole formed with the corner sunken portion, a horizontal hook formed at an inner surface of the horizontal cover plate, and a horizontal hook receiving hole formed with the lateral sunken portion.

* * * * *